US010947763B2

(12) United States Patent
Blum et al.

(10) Patent No.: US 10,947,763 B2
(45) Date of Patent: Mar. 16, 2021

(54) ARRANGEMENT FOR GUIDING A SLIDING DOOR OR FOLDING-SLIDING DOOR

(71) Applicant: Julius Blum GmbH, Hoechst (AT)

(72) Inventors: Lukas Blum, Bregenz (AT); Ingo Gasser, Hoechst (AT); Matthias Rupp, Hohenweiler (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/654,671

(22) Filed: Oct. 16, 2019

(65) Prior Publication Data

US 2020/0048947 A1 Feb. 13, 2020

Related U.S. Application Data

(63) Continuation of application No. PCT/AT2018/000036, filed on May 4, 2018.

(30) Foreign Application Priority Data

May 11, 2017 (AT) ..... A 50389/2017

(51) Int. Cl.
*E05F 15/00* (2015.01)
*E05D 15/58* (2006.01)
*E06B 3/50* (2006.01)

(52) U.S. Cl.
CPC ..... *E05D 15/581* (2013.01); *E06B 3/5045* (2013.01); *E05Y 2201/62* (2013.01); *E05Y 2900/212* (2013.01)

(58) Field of Classification Search
CPC . E05Y 2900/212; E05D 15/264; E05D 15/38; E05D 15/58; E05D 15/581;
(Continued)

(56) References Cited

U.S. PATENT DOCUMENTS 4,910,916 A 3/1990 Dubach et al.
4,974,912 A 12/1990 Rask et al.
(Continued)

FOREIGN PATENT DOCUMENTS

AT 519513 * 7/2018
CA 1322571 9/1993
(Continued)

OTHER PUBLICATIONS

International Search Report dated Jul. 19, 2018 in International (PCT) Application No. PCT/AT2018/000036.
(Continued)

*Primary Examiner* — Janet M Wilkens
(74) *Attorney, Agent, or Firm* — Wenderoth, Lind & Ponack, L.L.P.

(57) ABSTRACT

An arrangement for guiding a sliding door or folding-sliding door on a furniture wall includes a first guide system to be fastened on the furniture wall and a second guide system to be fastened on the furniture wall at a vertical distance from the first guide system. The two guide systems each have at least one guide and a guide body which is displaceably mounted on the guide, and a carrier on which the sliding door or folding-sliding door is to be fastened and which is connected in a movement-coupled manner to the two guide bodies of the guide systems. The carrier is assembled in the vertical direction from at least two carrier portions, and the at least two carrier portions can be releasably connected.

24 Claims, 12 Drawing Sheets

(58) Field of Classification Search
CPC ..... E06B 3/482; E06B 6/5045; E05F 1/10; E05F 1/1025
USPC ..... 312/328, 329, 109, 322, 139.1, 138.1, 312/140, 313, 297, 294; 49/254, 257, 49/259; 16/382, 96 D, 236, 237, 239, 16/241
See application file for complete search history.

(56) References Cited

U.S. PATENT DOCUMENTS

| | | | | |
|---|---|---|---|---|
| 5,078,461 | A * | 1/1992 | Beck | A47B 83/001 312/331 |
| 7,090,318 | B2 * | 8/2006 | Brown | E05D 15/58 312/110 |
| 7,959,242 | B2 | 6/2011 | Del Castillo | |
| 8,231,187 | B2 * | 7/2012 | Hoffman | E05D 15/58 16/382 |
| 8,303,056 | B2 | 11/2012 | Giorgi | |
| 8,424,983 | B1 * | 4/2013 | Strauss | A47B 51/00 312/247 |
| 2004/0046488 | A1 * | 3/2004 | Hogan | E06B 3/5045 312/322 |
| 2004/0100170 | A1 * | 5/2004 | Brown | E05D 15/58 312/322 |
| 2004/0239216 | A1 | 12/2004 | Castillo | |
| 2007/0159037 | A1 | 7/2007 | Hoffman | |
| 2010/0117500 | A1 | 5/2010 | Giorgi | |

FOREIGN PATENT DOCUMENTS

| | | |
|---|---|---|
| CN | 101490355 | 7/2009 |
| DE | 38 22 019 | 2/1989 |
| DE | 196 32 427 | 2/1998 |
| JP | 2-266080 | 10/1990 |
| WO | 2005/059282 | 6/2005 |
| WO | 2016/081961 | 6/2016 |

OTHER PUBLICATIONS

English translation of Search Report dated Dec. 25, 2018 in Taiwanese Application No. 107115015.

* cited by examiner

ARRANGEMENT FOR GUIDING A SLIDING DOOR OR FOLDING-SLIDING DOOR

BACKGROUND OF THE INVENTION

The present invention relates to an arrangement for guiding a sliding door or folding-sliding door on a furniture panel and a piece of furniture with at least one such arrangement.

In addition, the invention relates to a method for installing such an arrangement on a furniture panel.

Arrangements for guiding a sliding door or folding-sliding door on a furniture panel which are pre-installed as a complete package on a furniture panel and are also delivered to the customer in this way are already known. This means that, when assembling the furniture, the customer has to secure the heavy and large furniture panel including the arrangement to the piece of furniture.

This has the disadvantage that on the one hand the installation and on the other hand also the transport of such a furniture panel pre-installed with an arrangement are made more difficult. Furniture panels with pre-installed arrangements which have large dimensions protrude, for example, beyond Euro pallets, as a result of which damage can also occur to these furniture panels or these arrangements.

SUMMARY OF THE INVENTION

The object of the invention is to avoid at least one of the above-described disadvantages and to specify an improved arrangement compared with the state of the art and an improved piece of furniture, whereby installation is preferably made easier.

A further object of the invention is to specify an improved method for installing such an arrangement on a furniture panel.

An essential idea with respect to the arrangement according to the invention is that the support is composed in the vertical direction of at least two support segments, wherein the at least two support segments are releasably connectable. This measure makes it possible to divide the support into smaller support segments, whereby transport is made easier and damage possibly occurring during transport can be prevented.

In order that the release of the connection and also the assembly of the support segments are made easier, it can moreover be provided that the releasable connection of the support segments provided is effected via angled plates, which are preferably connectable to the support segments via a plug-in and/or screw connection.

In the case of a piece of furniture with at least one furniture panel, at least one sliding door or folding-sliding door, and at least one arrangement, wherein the first and second guide systems are fastened to the at least one furniture panel and the at least one sliding door or folding-sliding door is fastened to the support, it can be provided that the piece of furniture has a receiving area for receiving components of a kitchen, a clothes-storage device, or the like. The items just named can thereby be arranged in the piece of furniture, and can be covered by the arrangement and the sliding door or folding-sliding door.

BRIEF DESCRIPTION OF THE DRAWINGS

Further advantages and details of the invention are revealed by the figures and the associated description of the figures, wherein the method according to the invention is also explained in more detail with reference to the description of the figures. There are shown in.

DETAILED DESCRIPTION OF THE INVENTION

Figure 1A:
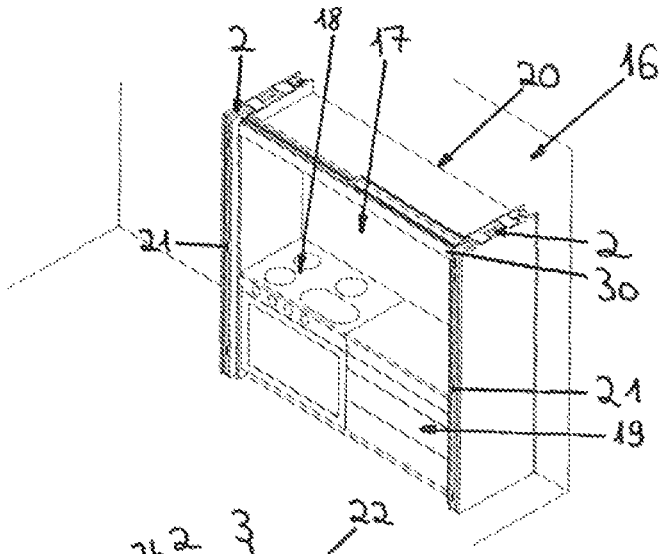
FIGS. 1*a*-1*c* perspective views of a piece of furniture with two folding-sliding doors, wherein the folding-sliding doors are represented in different positions, FIG. 2 a furniture panel with the two guide systems and the pull cord device in a top view, FIGS. 3*a*-3*b* a furniture panel with two guide systems arranged thereon in a perspective view and a detail representation thereof, FIGS. 4*a*-4*c* a furniture panel with two guide systems arranged thereon in a perspective view and two detail representations thereof, FIGS. 5*a*-5*c* detail representations of the synchronization device, FIGS. 6*a*-6*b* the support and the releasable connection between two support segments in a perspective view, FIGS. 7*a*-7*b* the furniture panel with two guide systems arranged thereon in a perspective view and a detail representation thereof, FIGS. 8*a*-8*b* the furniture panel with two guide systems arranged thereon in a perspective view and a detail representation thereof, FIGS. 9*a*-9*c* the furniture panel with two guide systems arranged thereon and two support segments connected to each other in a perspective view and two detail representations of the releasable connection via angled plates, FIG. 10 the furniture panel with a further embodiment example of the support in a perspective view, FIGS. 11*a*-11*c* the furniture panel and the further embodiment example of the support in perspective views, and FIG. 12 the furniture panel with arrangement and assembled support.
Figure 1B:
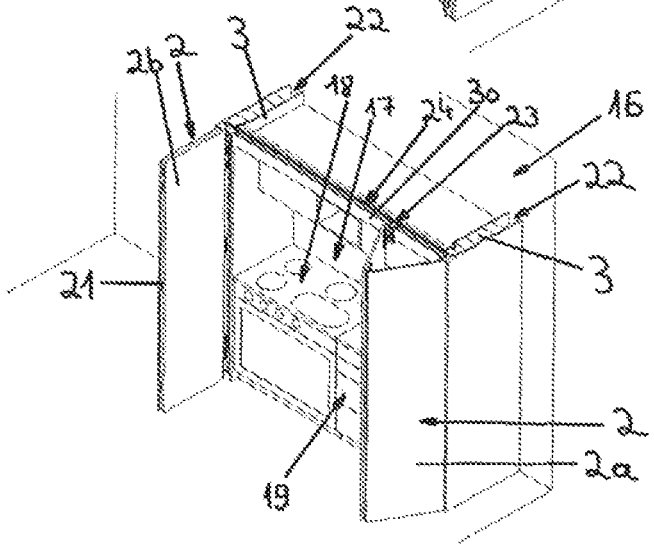
Figure 1C:
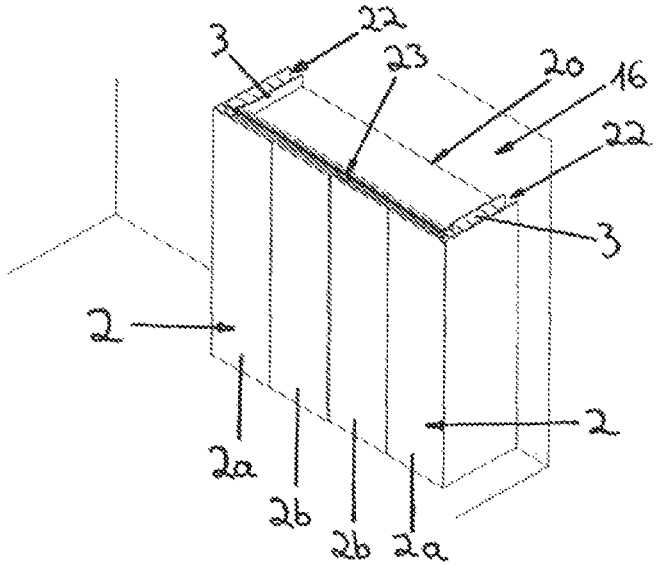

FIGS. 1*a*, 1*b* and 1*c* show a piece of furniture 16, with a fixed part 20, two furniture panels 3 and two folding-sliding doors 2. These two folding-sliding doors 2 each have a first door leaf 2*a* and a second door leaf 2*b*, wherein the two door leaves 2*a*, 2*b* can be folded via the folding door hinge 21. The piece of furniture 16 furthermore has a receiving area 17 and two laterally arranged receiving slots 22 or "pockets". It is thus provided that the piece of furniture 16 has a receiving area 17 for receiving components of a kitchen 18 (for example electrical devices such as hob, oven, etc.), a clothes-storage device 19 (for example drawers, clothes hangers, boxes, etc.) or the like.

In addition, it is provided that the piece of furniture 16 has at least one receiving slot 22, which is preferably arranged laterally in or on the piece of furniture 16 and into which the at least one folding-sliding door 2 is retractable. Thus either the receiving slot 22 can be arranged on the piece of furniture 16 from the outside or else the receiving slot 22 is formed in the piece of furniture 16, for example by the arrangement of an additional panel. In the receiving slots 22 or, more precisely, on the furniture panels 3 the arrangements 1 (not visible) are arranged for guiding the folding-sliding doors 2, with the result that the folding-sliding doors 2 are retractable into these receiving slots 22. The two receiving slots 22 have a clear width of from 10 to 30 cm and/or a height of from 100 to 250 cm and/or a depth of from 60 to 100 cm.

The representation shown in FIG. 1*a* corresponds to the parked position of the folding-sliding doors 2 and that in FIG. 1*c* corresponds to the closed position of the folding-sliding doors 2. The second door leaf 2*b* is in each case coupled to a slide mechanism 23, wherein the slide mechanism 23 is displaceable along a slide mechanism rail 24. This slide mechanism rail 24 is arranged substantially transverse to the guide systems 4*a*, 4*b* (not visible) on the piece of furniture 16. In addition, a bar 30 is provided which either is part of the slide mechanism rail 24 or is designed as a component separate therefrom. The movement of the folding-sliding doors 2 between the parked position and the closed position is thus made possible by the guide systems 4*a*, 4*b* and the slide mechanism rail 24. Starting from the parked position of the folding-sliding doors 2, in which the door leaves 2*a*, 2*b* are aligned substantially parallel to each other, the folding-sliding doors 2 can thus be moved into the position in FIG. 1*b*, which can be seen with reference to the folding-sliding doors 2 represented on the left. In the process, the folding-sliding doors 2 are displaced along the guides 5*a*, 5*b* (not visible) of the guide systems 4*a*, 4*b*. Subsequently, the folding-sliding doors 2 are brought into the substantially coplanar position according to FIG. 1*c*. For this, in each case the door leaf 2*b* is displaced with the aid of the slide mechanism 23 along the slide mechanism rail 24, until the closed position of the folding-sliding doors 2 is reached, in which the two door leaves 2*a*, 2*b* are aligned substantially coplanar. The same process is passed through in reverse order to move the folding-sliding doors 2 from their closed position into their parked position.

Figure 2:
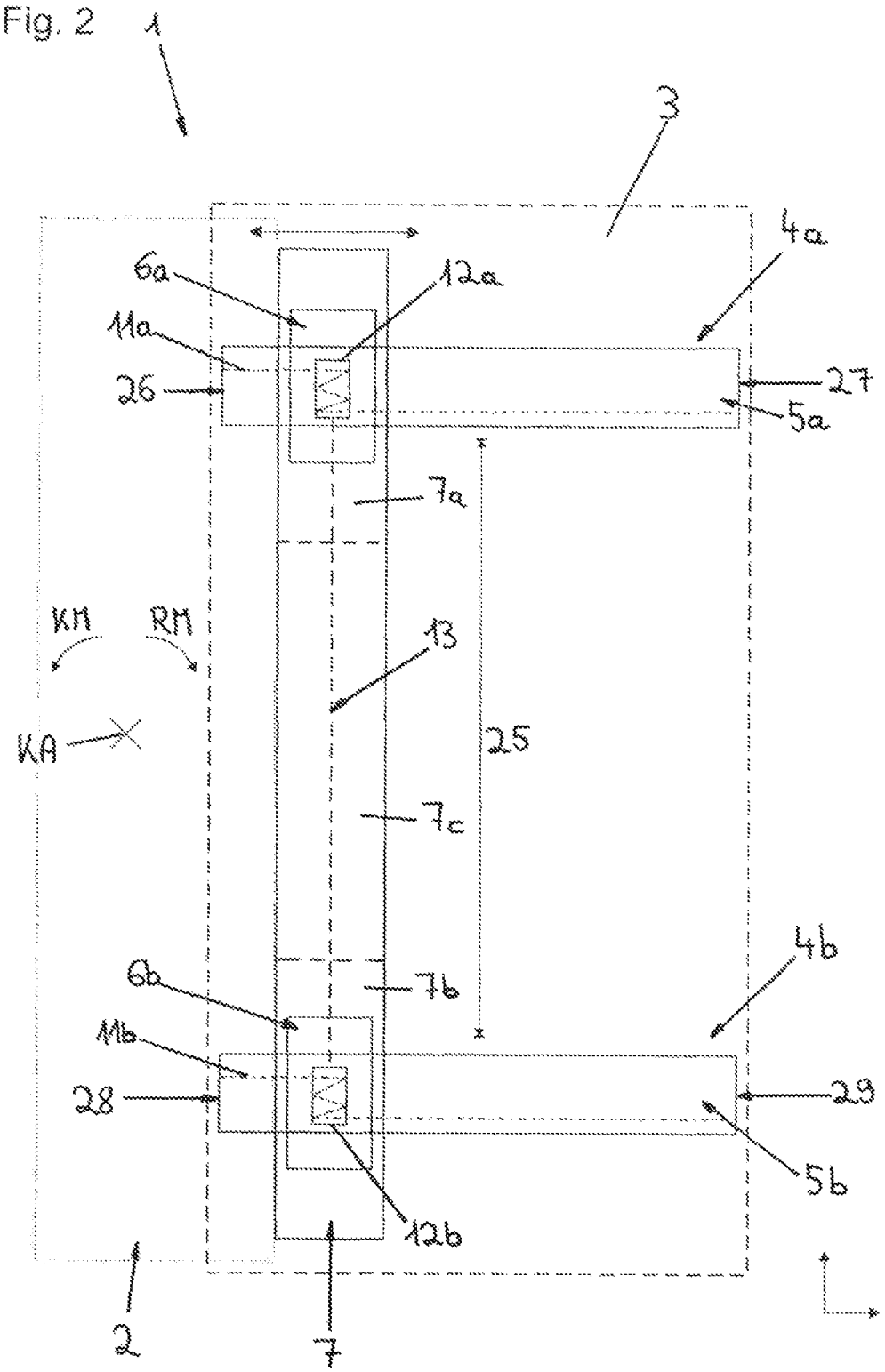

FIG. 2 shows an embodiment example of the arrangement 1 for guiding a sliding door or folding-sliding door 2 on a furniture panel 3. This arrangement 1 can thus be used to move a folding-sliding door 2 along the furniture panel 3 into or out of the receiving slots 22, which are provided in the case of a piece of furniture 16 according to FIGS. 1*a* to 1*c*. A first guide system 4*a* to be fastened to the furniture panel 3 and a second guide system 4*b* to be fastened to the furniture panel 3 at a vertical distance 25 from the first guide system 4*a* are provided, wherein the two guide systems 4*a*, 4*b* each have a guide 5*a*, 5*b* and a guide body 6*a*, 6*b* displaceably mounted on the guide 5*a*, 5*b*. Furthermore, the arrangement 1 comprises a support 7, to which the sliding door or folding-sliding door 2—indicated by a dotted line—is to be fastened and which is connected in a movement-coupled manner to the two guide bodies 6*a*, 6*b* of the guide systems 4*a*, 4*b*. The division of the support 7 into the three support segments 7*a*, 7*b*, 7*c* is also indicated by dashed lines. It is thus provided that the support 7 is composed in the vertical direction of at least three support segments 7*a*, 7*b*, 7*c*, wherein a first support segment 7*a* is connected to the guide body 6*a* of the first guide system 4*a* and a second support segment 7*b* is connected to the guide body 6*b* of the second guide system 4*b*, and wherein a third support segment 7*c* connects the first and second support segments 7*a*, 7*b* to each other.

Furthermore, the arrangement 1 has a pull cord device to compensate for a tilting moment KM of the support 7 or of a sliding door or folding-sliding door 2 arranged thereon about a tilt axis KA through a righting moment RM. In the case of a vertical alignment of the support 7 or of the sliding door or folding-sliding door 2 the tilt axis KA is aligned horizontally. The pull cord device thus ensures that the sliding door or folding-sliding door 2 is guided stably in every position, without a tilting or, in the case of a guiding on two guide systems 4*a*, 4*b* aligned substantially parallel, a canting resulting.

In addition, it is provided that the pull cord device comprises two pull cords 11*a*, 11 *b* separated from each other, wherein the pull cord 11*a* is arranged between the guide body 6*a* of the first guide system 4*a* and both ends 26, 27 of the guide 5*a* of the first guide system 4*a* and is formed without connection to the second guide system 4*b*, and that the pull cord 11*b* is arranged between the guide body 6*b* of the second guide system 4*b* and both ends 28, 29 of the guide 5*b* of the second guide system 4*b* and is formed without connection to the first guide system 4*a*. In this embodiment example, although a synchronization device 13 is drawn in between the gripping means 12*a*, 12*b*, it can also be omitted. This thus means that the pull cords 11*a* and 11*b* are not connected firmly to the gripping means 12*a* and 12*b* with their ends, but only rest against the gripping means 12*a*, 12*b* in a frictionally engaged manner with at least one, preferably several, windings. It can thus also be provided that each of the guide bodies 6*a*, 6*b* comprises at least one gripping means 12*a*, 12*b* for at least one pull cord 11*a*, 11*b*, and the gripping means 12*a*, 12*b* of the guide bodies 6*a*, 6*b* can be coupled via at least one synchronization device 13 separated from the support 7, preferably wherein the at least one synchronization device 13 is formed to transmit a torque between the gripping means 12*a*, 12*b* of the guide bodies 6*a*, 6*b*.

The ends of the pull cords 11*a* and 11 *b* are in each case fastened to the ends 26 and 27 or 28 and 29 of the guides 5*a* and 5*b*. During a movement of the support 7 along the guide systems 4*a* and 4*b* the pull cords 11*a* and 11*b* are unwound by a particular amount and at the same time wound again by the same amount, with the result that the number of windings remains substantially unchanged. Through the winding and unwinding of the pull cords 11*a*, 11 *b* during a displacement of the support 7 along the guides 5*a*, 5*b* the gripping means 12*a*, 12*b* are set in rotation about an axis of rotation. This axis of rotation can be effected, depending on the mounting of the gripping means 12*a*, 12*b* on the guide bodies 6*a*, 6*b*, either about a vertical axis or about a horizontal axis. The gripping means 12*a*, 12*b* here need not necessarily be storage and winding devices. The only essential thing is that the pull cords 11*a*, 11 *b* are held tightly between the ends 26, 27, 28, 29 of the guides 5*a*, 5*b* and the guide bodies 6*a*, 6*b* in every position of the guide bodies 6*a*, 6*b* relative to the guides 5*a*, 5*b*. In this way, the pull cords 11*a*, 11 *b* can exert a force between the ends 26, 27, 28, 29 and the guide bodies 6*a*, 6*b* and thus provide a righting moment RM to compensate for the tilting moment KM.

It is pointed out that the embodiment example of the pull cord device according to FIG. 2 is to be understood only by way of example. Alternative embodiment examples can be found in the application under the file number A 50019/2017.

Figure 3A:
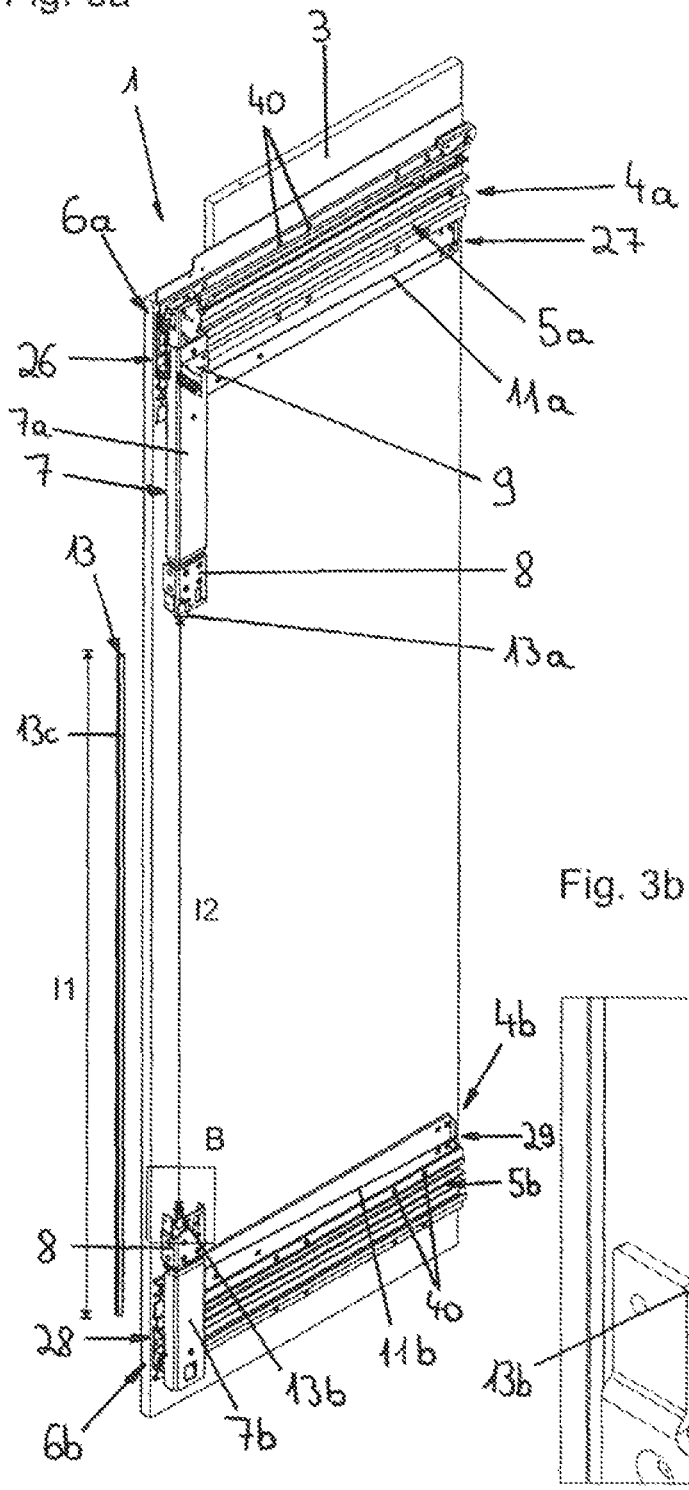
Figure 3B:
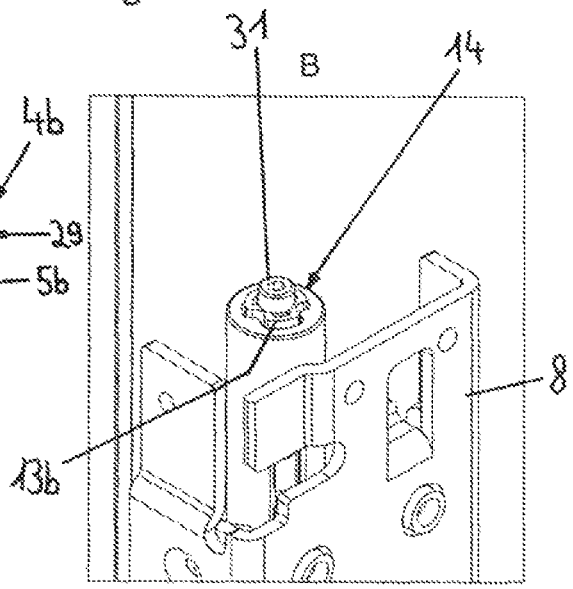

FIG. 3*a* shows the furniture panel 3 and the arrangement 1 according to FIG. 2 in a perspective view. The support segments 7*a*, 7*b* each have an angled plate 8, which serves to connect the respective support segments 7*a*, 7*b*, 7*c* to each other. An interface 9, which serves to fasten the folding-sliding door 2, is represented here. In this connection, it is pointed out that in the case of the arrangement 1 it can be provided that the support 7 has at least two, preferably three, interfaces 9 for fastening the sliding door or folding-sliding door 2, wherein the at least two interfaces 9 are arranged on different support segments 7*a*, 7*b*, 7*c* of the support 7, preferably wherein at least one interface 9 is adjustable in the vertical direction. Furthermore, the synchronization device 13 is shown, which is composed in the vertical direction of three synchronization segments 13*a*, 13*b*, 13*c*, wherein the three synchronization segments 13*a*, 13*b*, 13*c* are releasably connectable. The length l1 of the synchronization segment 13*c* is between 5 and 20 mm, preferably 10 mm, smaller than the clear width l2 between the two synchronization segments 13*a* and 13*b*. Moreover, the passage openings 40, which serve to fasten the two guide systems 4*a*, 4*b* on the furniture panel 3, can be seen. The fastening can be effected for example via screws. It can moreover be provided that at least one of the synchronization segments 13*a*, 13*b*, 13*c*, preferably the third synchronization segment 13*c*, is adjustable in its length. It is thereby ensured that the synchronization device 13 can be used for folding-sliding doors 2 with different heights. FIG. 3*b* shows a detail representation of the area B according to FIG. 3*a*. The synchronization segment 13*b* can be seen here. A sleeve 14 is mounted displaceably on the circumference of the synchronization segment 13*b*, wherein a spacer screw 31 is additionally arranged at the upper end of the synchronization segment 13*b*.

Figure 4A:
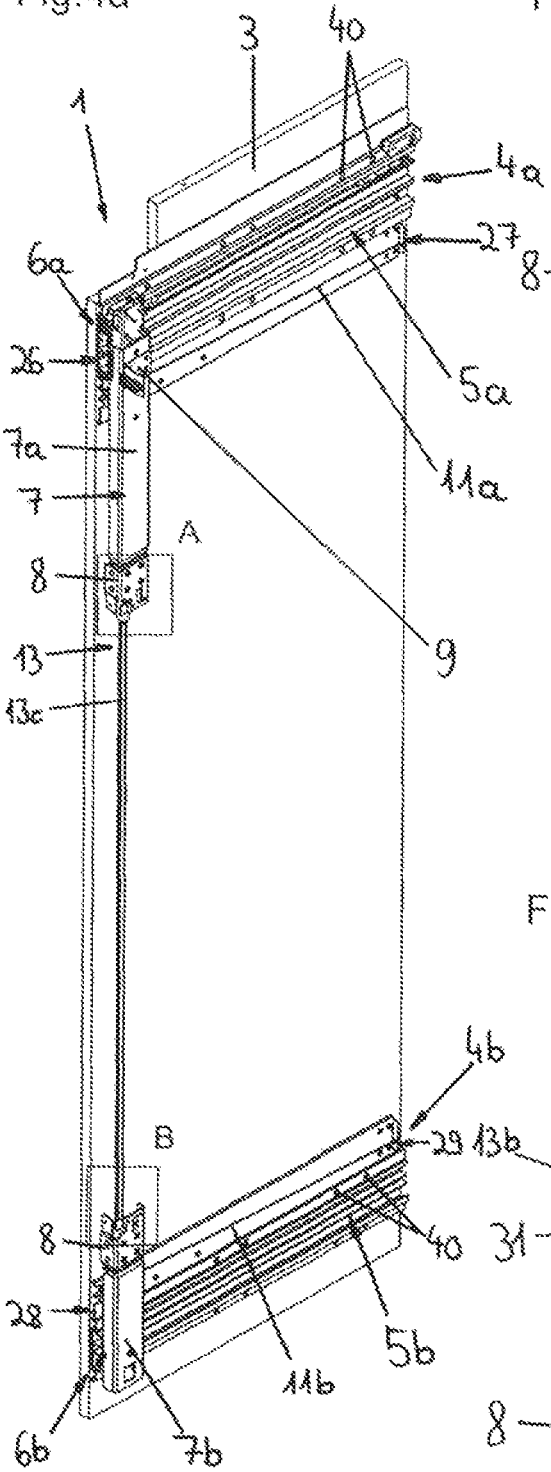
Figure 4B:
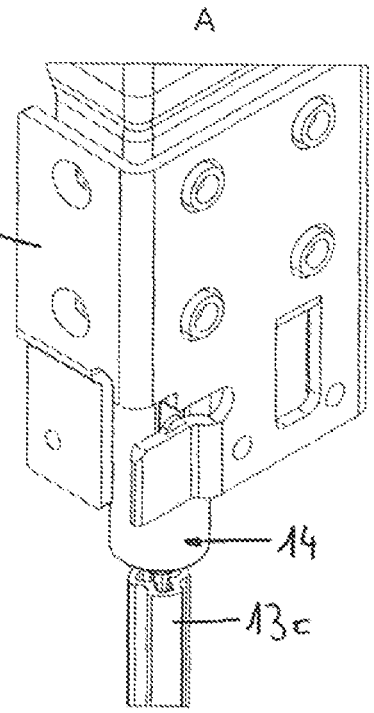
Figure 4C:
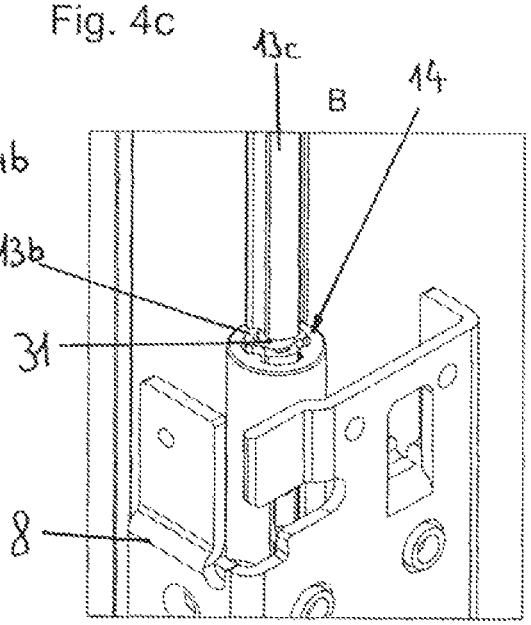

FIG. 4*a* shows the furniture panel 3 and the arrangement according to FIG. 3*a*, wherein the synchronization segment 13*c* has already been fitted on the spacer screw 31. For this, the synchronization segment 13*c* has thus been displaced in the horizontal direction and positioned on the spacer screw 31. FIG. 4*b* and FIG. 4*c* show a detail representation of the area A or of the area B according to FIG. 4*a*. It can be seen here that an interspace 32 is formed in each case between the synchronization segments 13*a* and 13*c* or 13*b* and 13*c*, wherein the synchronization segment 13*c* is height-adjusted by the spacer screw 31. The inner contour of the sleeve 14 is based on the outer contour of the synchronization segments 13*a*, 13*b*, 13*c*, with the result that the sleeve 14 is displaceable along these synchronization segments 13*a*, 13*b*, 13*c*. It is pointed out that the installation of the synchronization device 13 or the connection of the synchronization segments 13*a*, 13*b*, 13*c* can be carried out from the front of the piece of furniture 16. Only the guide bodies 6*a*, 6*b* and thus also the support 7 need to be moved into the position shown according to FIG. 4*a*.

Figure 5A:
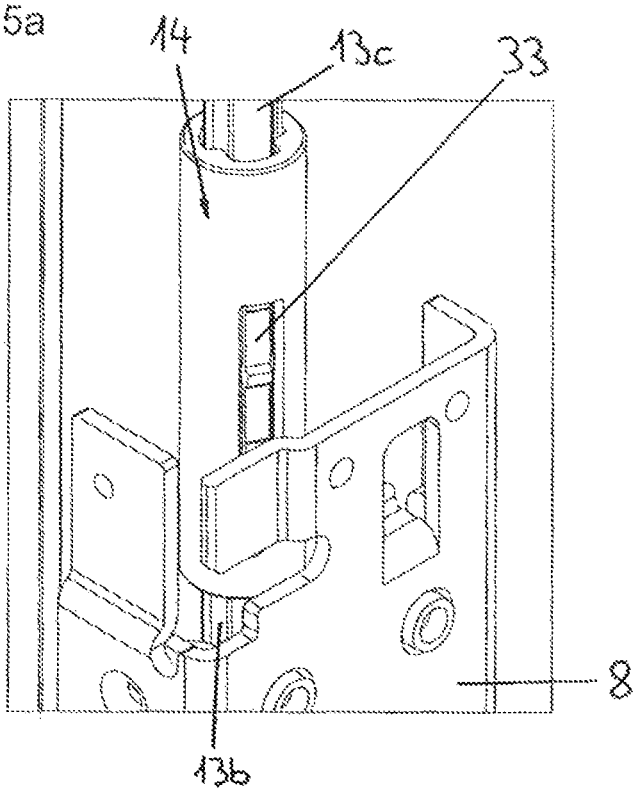
Figure 5B:
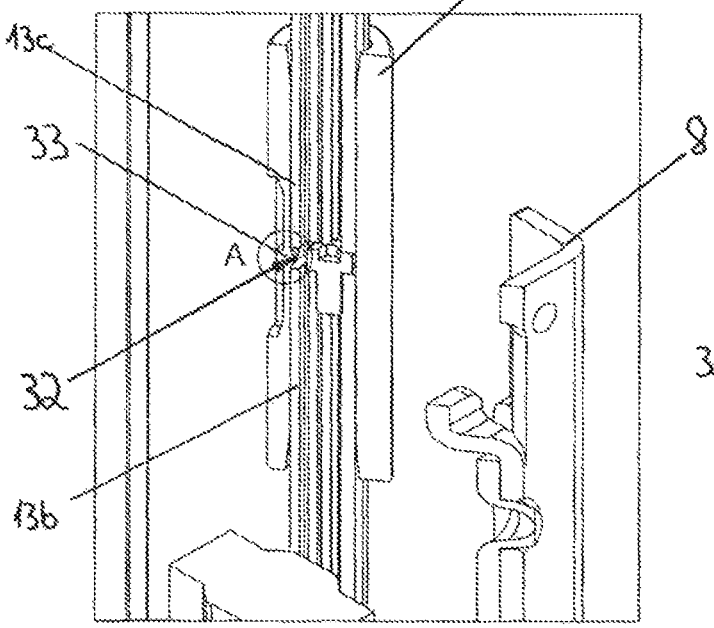
Figure 5C:
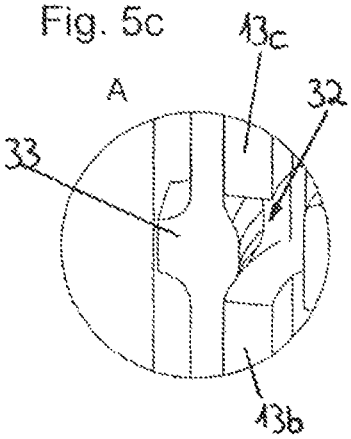

FIGS. 5*a* to 5*c* show the releasable connection between the synchronization segments 13*b* and 13*c*. It is pointed out that the releasable connection between the synchronization segments 13*a* and 13*c* is effected analogously thereto. The sleeve 14 is thus displaced in the direction of the synchronization segment 13*c*, until the frictionally engaged spring 33 of the sleeve 14 reaches the interspace 32 and snaps into place in it. It is thus provided that the releasable connection of the synchronization segments 13*a*, 13*b*, 13*c* is effected via sleeves 14 displaceable in the vertical direction.

Figure 6A:
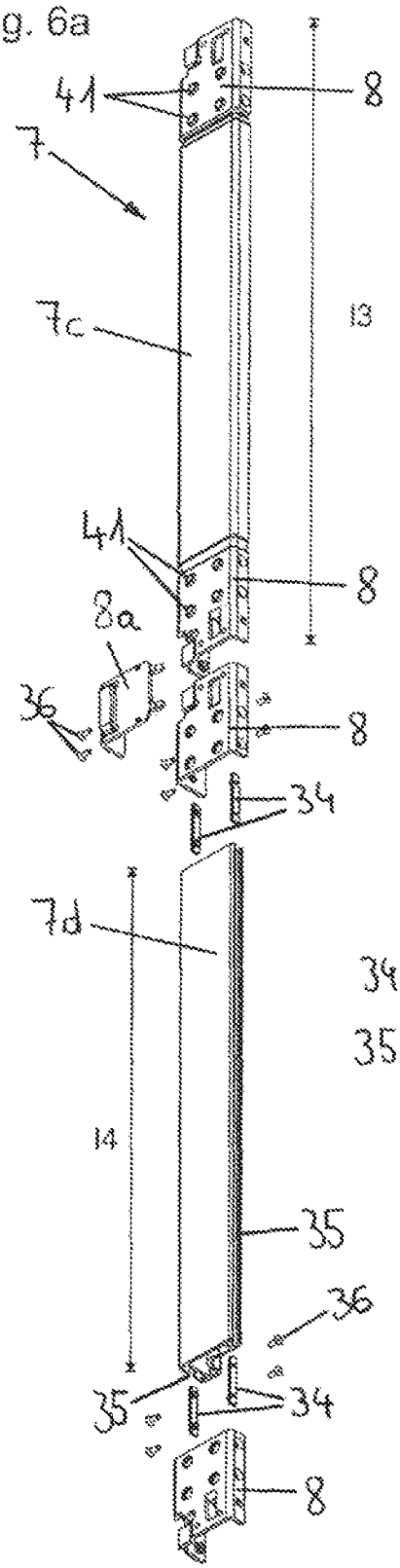

FIG. 6*a* shows the two support segments 7*c*, 7*d* of the support 7. It is thus provided that the third support segment 7*c* has a fixed length l3 and optionally a fourth support segment 7*d*, which is adjustable in its length l4, is provided. Thus, the support 7 can be adjusted to different heights of a folding-sliding door 2. The upper angled plate 8 of the support segment 7*c* in the representation in this case serves to connect to the support segment 7*a*, wherein it is provided that this support segment 7*c* and the two angled plates 8 connected to it are pre-installed. The angled plates 8 are riveted to the support segment 7*c* via the rivets 41. The length l3 of the support segment 7*c* is chosen corresponding to the smallest height of a folding-sliding door 2, with the result that the support segment 7*d* is not necessary in the case of a folding-sliding door 2 with this height. If, however, taller folding-sliding doors 2 are provided, then the support segment 7*d* can be accordingly adjusted in its length l4 and connected to the support segment 7*c*. The lower angled plate 8 of the support segment 7*c* serves to connect to the upper angled plate 8 of the support segment 7*d*. In this case a further angled plate 8*a* is provided, which connects these two angled plates 8 to each other. To connect the respective angled plates 8 to the support segment 7*d*, slot nuts 34 are provided in each case, which are displaceable in the grooves 35 of the support segment 7*d*. The length l4 of the support segment 7*d* can thereby be adjusted, wherein it is furthermore guaranteed that the angled plates 8 are fastenable to the support segment 7*d*.

Figure 6B:
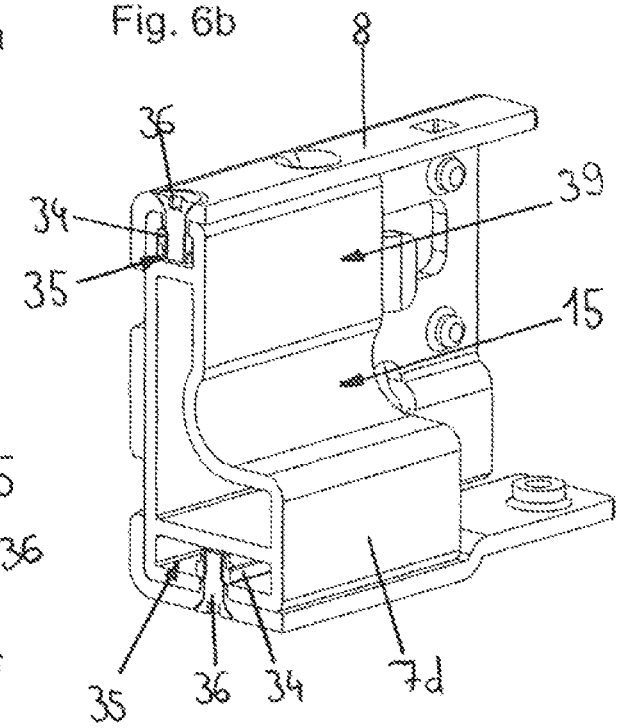

FIG. 6*b* shows a sectional representation with respect to the connection between angled plate 8 and support segment 7*d*. The slot nuts 34 are inserted into the grooves 35 of the support segment 7*d* provided for them. The angled plates 8 are then fitted on the support segment 7*d*, with the result that the respective holes for connecting the angled plates 8 to the support segment 7*d* are arranged one over another. After that, the countersunk screws 36 can be screwed into these holes, with the result that a releasable plug-in and screw connection between the support segment 7*d* and the angled plates 8 is achieved. It is furthermore provided that the support 7 or the support segments 7*a*, 7*b*, 7*c*, 7*d* are formed substantially L-shaped in cross section, and/or have at least one recess 15 for receiving at least one optionally provided synchronization device 13. Because of the substantially L-shaped formation of the support segment 7*d*, a flattened spot 39 thus results, with the result that the installation of the support segment 7*d* is made easier.

Figure 7A:
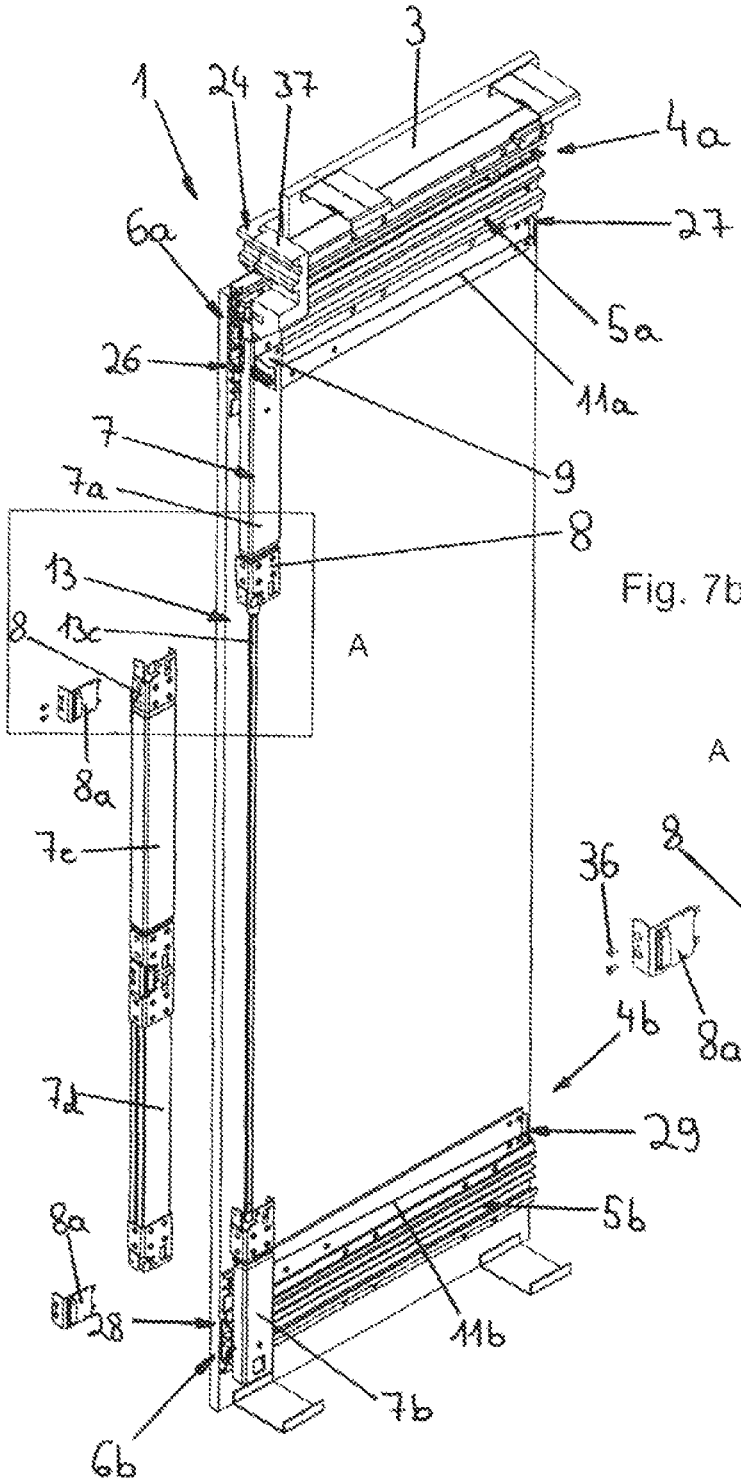

FIG. 7*a* shows the furniture panel 3 and the arrangement 1. A part of the slide mechanism rail 24 can be seen here, wherein a connecting piece 37 for the slide mechanism rail 24 is additionally arranged on the support segment 7*a*. The connecting piece 37 is formed as a support. In order to make it possible to displace the folding-sliding door 2 along the guides 5*a*, 5*b* of the guide systems 4*a*, 4*b*, the slide mechanism 23 is displaced onto this connecting piece 37, with the result that the door leaves 2*a*, 2*b* are aligned substantially parallel to each other. In this case, the two support segments 7*c*, 7*d* have already been connected to each other and can be connected to the two support segments 7*a*, 7*b* as a pre-installed support 7. Starting from FIG. 6*a*, to connect the two partial segments 7*c*, 7*d*, the lower angled plate 8 of the support segment 7*c* and the upper angled plate 8 of the support segment 7*d* are moved towards each other until they rest against each other. The angled plate 8*a* according to the representation of FIG. 6*a* is then pushed towards the right into the angled plates 8 and releasably fixed to each other via a plug-in and screw connection. This type of connection can be seen more precisely with reference to FIG. 9*c*. To connect the two support segments 7*c*, 7*d* connected to each other to the support segments 7*a*, 7*b*, the support segments 7*c*, 7*d* are then shifted via the synchronization device 13, with the result that the respective angled plates 8 rest against each other. This is possible because of the L-shaped formation and the flattened spot 39 of the support segments 7*c*, 7*d*. The synchronization device 13 is thus received in the recess 15.

Figure 7B:
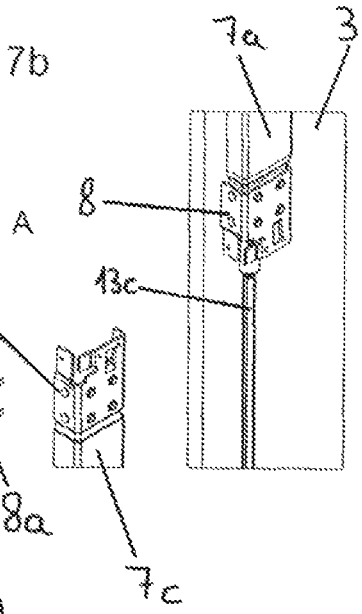

FIG. 7*b* shows a detail representation of the area A of FIG. 7*a*. At this point it is pointed out that the installation of the support 7 can also be carried out from the front of the piece of furniture 16, if the guide bodies 6*a*, 6*b* are moved into the position according to FIG. 7*a*.

Figure 8A:
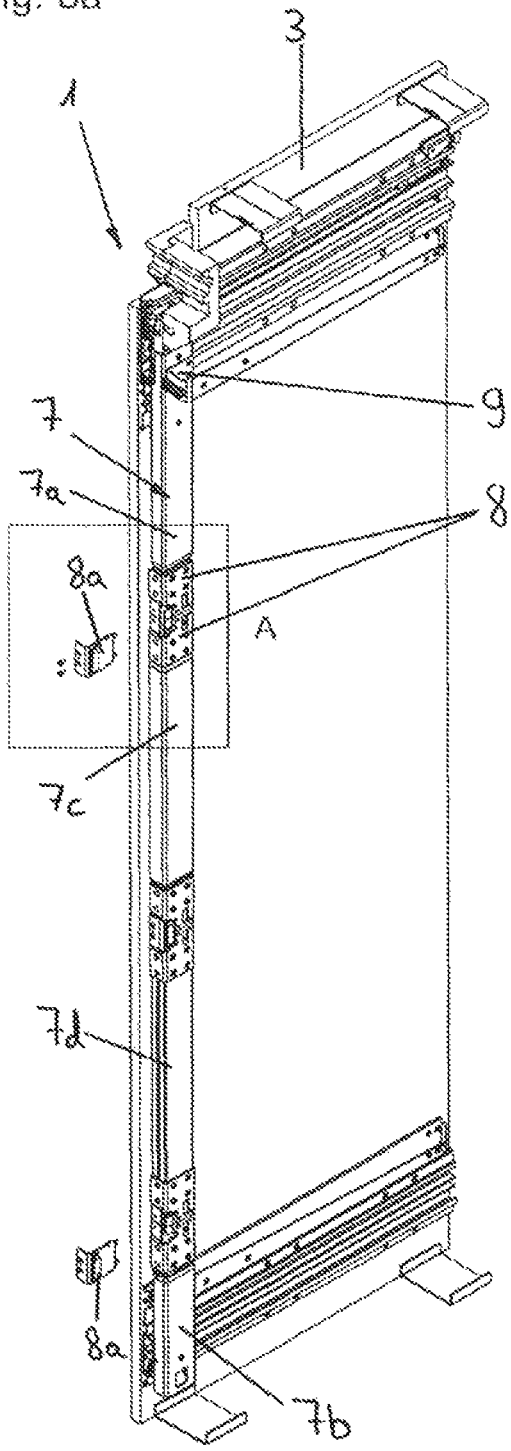
Figure 8B:
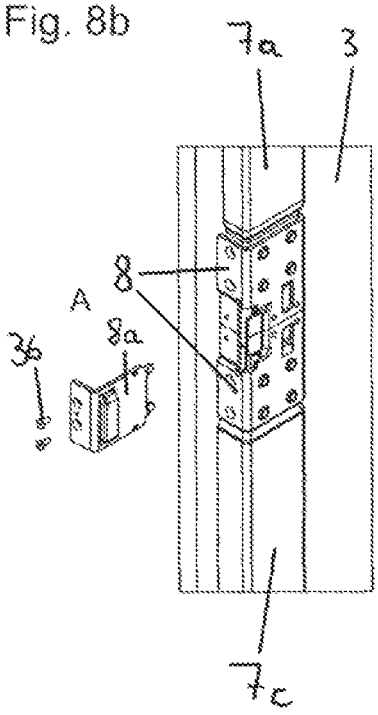

FIG. 8*a* shows the support segments 7*c*, 7*d* in their position for installation with the support segments 7*a*, 7*b*. This can also be seen with reference to FIG. 8*b*, which shows a detailed view of the area A of FIG. 8*a*. To connect the respective support segments 7*a*, 7*b*, 7*c*, 7*d*, the angled plates 8*a* are thus pushed into the angled plates 8, with the result that the support segments 7*a*, 7*b*, 7*c*, 7*d* or the angled plates 8 are releasably connected to each other via a plug-in connection. The countersunk screws 36 are then screwed into the holes provided for them, with the result that a screw connection is also effected.

Figure 9A:
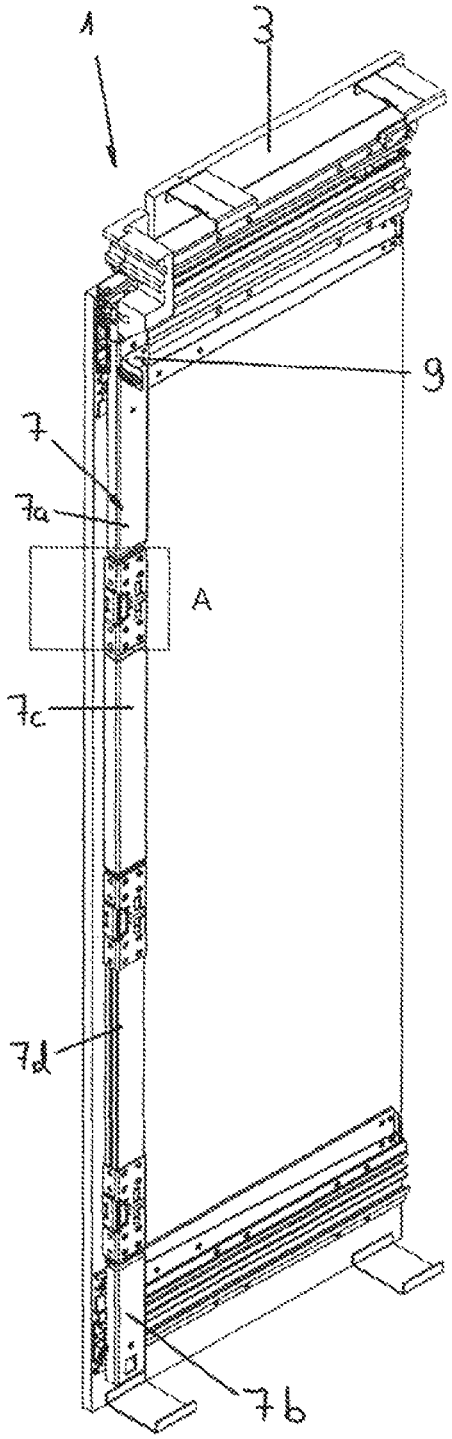
Figure 9B:
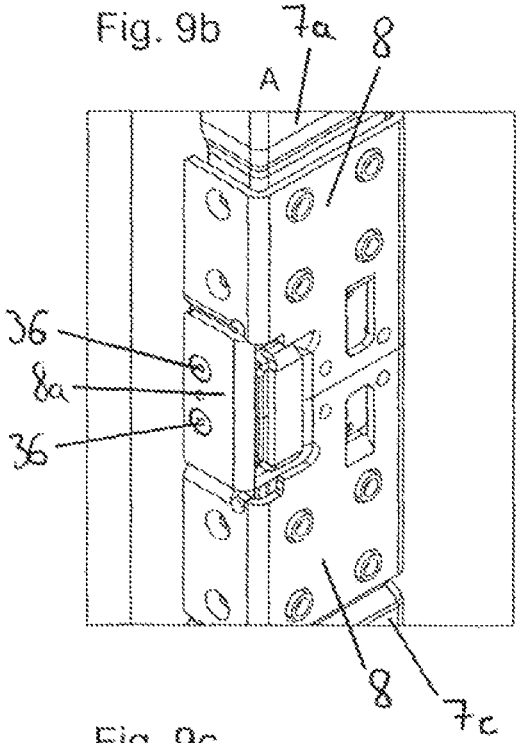
Figure 9C:
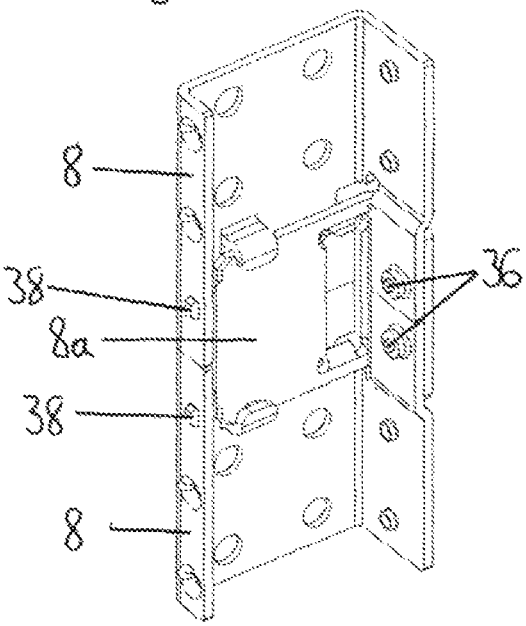

FIGS. 9*a* to 9*c* show the support segments 7*a*, 7*b*, 7*c*, 7*d* releasably connected to each other. FIG. 9*b* shows a more precise representation of the area A of FIG. 9*a* and FIG. 9*c* shows a more precise view of the plug-in and screw connection between the angled plates 8, 8*a*. To connect the angled plates 8 to each other, it is provided that the angled plate 8*a* is pushed into the angled plates 8 until the plug-in connectors 38 engage in the corresponding openings of the angled plates 8. After that the countersunk screws 36 are screwed into the respective holes of the angled plates 8, with the result that a plug-in and screw connection results.

Figure 10:
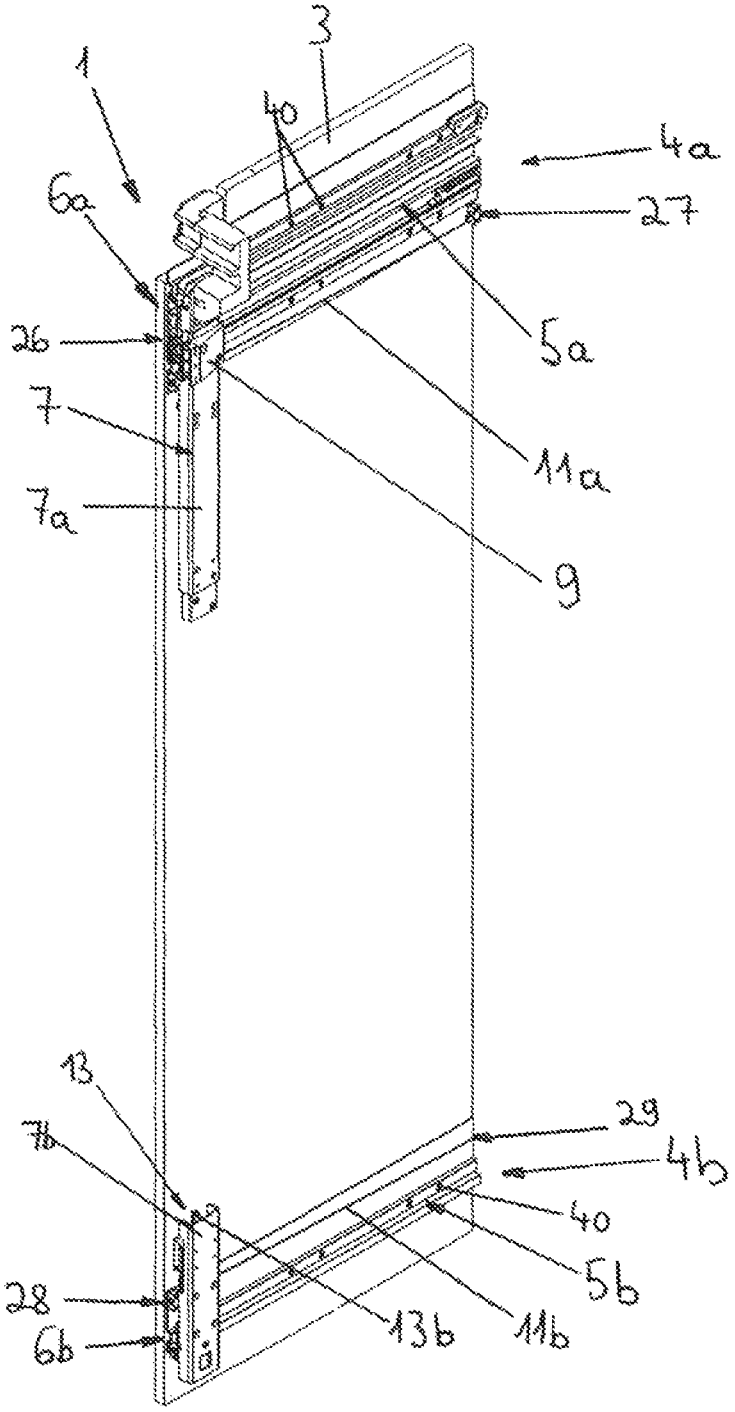

FIG. 10 shows the furniture panel 3 and the arrangement 1, wherein the support 7 is formed according to an alternative embodiment. In this case the support 7 has a first support segment 7*a* and a second support segment 7*b*. The first support segment 7*a* is connected in a movement-coupled manner to the guide body 6*a* of the first guide system 4*a* and the second support segment 7*b* is connected in a movement-coupled manner to the guide body 6*b* of the second guide system 4*b*. An interface 9 for fastening the folding-sliding door 2 is arranged in each case on the support segment 7*a* and on the support segment 7*b*.

Figure 11A:
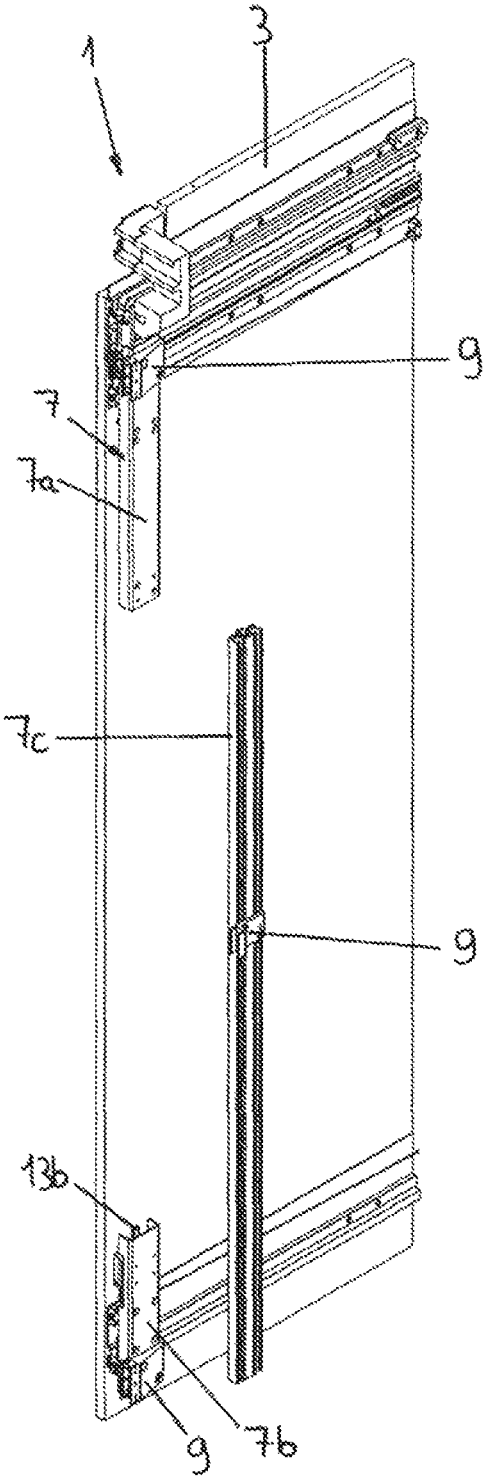

In comparison with FIG. 10, FIG. 11*a* additionally shows the third support segment 7*c*, which serves to connect the first 7*a* and the second 7*b* support segments to each other.

Figure 11B:
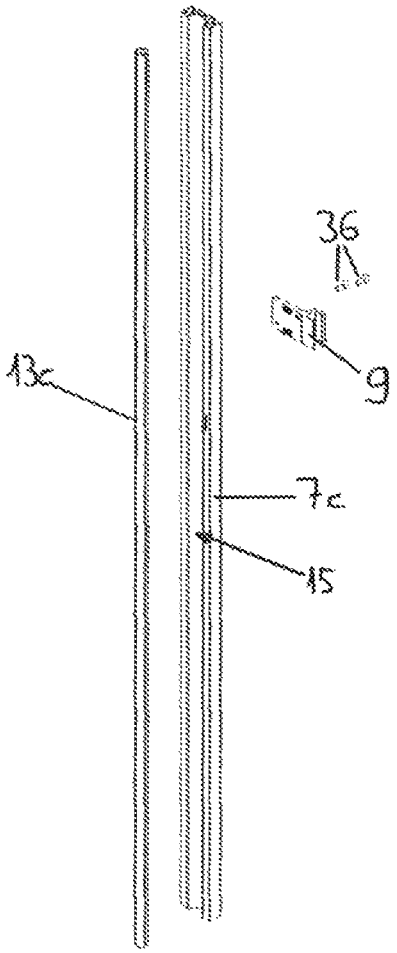
Figure 11C:
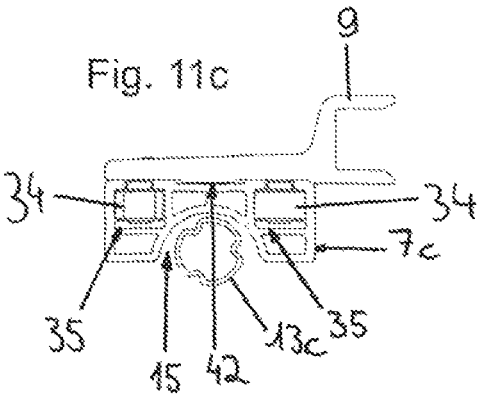

FIG. 11*b* shows the third support segment 7*c* in a perspective view and FIG. 11*c* shows the third support segment 7*c* with the interface 9 in a sectional perspective. The support segment 7*c* has a recess 15 for receiving the third synchronization segment 13*c*. The interface 9 represented is fastenable to the support segment 7*c* at different vertical positions with the aid of countersunk screws 36. This is achieved by the slot nuts 34 displaceable in the grooves 35. The slot nuts 34 are thus pushed into the desired position and then the countersunk screws 36 are screwed into the slot nuts 34 through the interface 9, with the result that the interface 9 is fixed in the desired position. With reference to FIG. 11*c* it can in addition be seen that on the side facing the support segment 7*c* the interface 9 has a friction surface 42, which cooperates with the support segment 7*c*. An improved fastening of the interface 9 to the support segment 7*c* thereby results.

Figure 12:
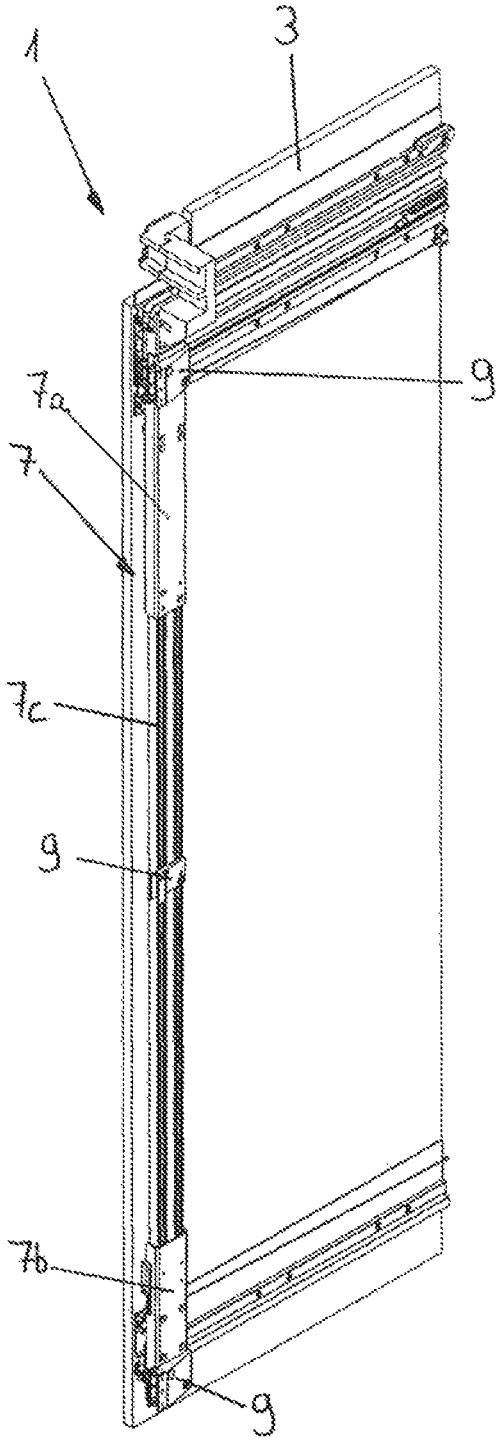

FIG. 12 shows the assembled support 7, wherein the support segment 7*c* connects the first support segment 7*a* and the second support segment 7*b* to each other.

In the case of an arrangement 1 according to the invention, it can thus be provided that all pre-installed components of the arrangement 1 have a maximum length of 1200 mm and a maximum width of 800 mm, with the result that they can be arranged on a Euro pallet for shipping purposes. The pre-installed components include in this respect for example:

- the first guide system 4*a* and the first support segment 7*a* connected to the guide body 6*a* of the first guide system 4*a*,
- the second guide system 4*b* and the second support segment 7*b* connected to the guide body 6*b* of the second guide system 4*b*, and
- the support segment 7*c* pre-installed with the angled plates 8 via rivets 41 according to FIG. 6*a*.

The method according to the invention for installing the arrangement 1 on the furniture panel 3 is explained with reference to FIGS. 2 to 9*c*, wherein:

- in a first method step the first guide system 4*a* or the second guide system 4*b* is fastened to the furniture panel 3,
- in a second method step the other guide system 4*a*, 4*b* is fastened to the furniture panel at a vertical distance 25 from the guide system 4*a*, 4*b* fastened to the furniture panel 3 during the first method step, and
- in a third method step the guide bodies 6*a*, 6*b* of the guide systems 4*a*, 4*b* are connected to each other in a movement-coupled manner via the support 7, wherein the at least two support segments 7*a*, 7*b*, 7*c*, 7*d* of the support 7 are releasably connected.

It can be provided that the arrangement 1 has at least one synchronization device 13, and in a further method step, which is carried out before or after the third method step, the at least one synchronization device 13 is arranged between the guide bodies 6*a*, 6*b* of the guide systems 4*a*, 4*b*, wherein the at least two synchronization segments 13*a*, 13*b*, 13*c* are releasably connected. It is preferably provided that the support 7 and the at least one optionally provided synchronization device 13 are moved in the horizontal direction for the installation.

LIST OF REFERENCE NUMBERS

1 arrangement
2 folding-sliding door
2*a* first door leaf
2*b* second door leaf
3 furniture panel
4*a* first guide system
4*b* second guide system
5*a* guide of the first guide system
5*b* guide of the second guide system
6*a* guide body of the first guide system
6*b* guide body of the second guide system
7 support
7*a* first support segment
7*b* second support segment
7*c* third support segment
7*d* fourth support segment
8 angled plate
8*a* angled plate
9 interfaces
11*a* pull cord
11*b* pull cord
12*a* gripping means
12*b* gripping means
13 synchronization device
13*a* first synchronization segment
13*b* second synchronization segment
13*c* third synchronization segment
14 sleeves
15 recess
16 piece of furniture
17 receiving area
18 components of a kitchen
19 clothes-storage device
20 fixed part of the piece of furniture
21 folding door hinge
22 receiving slot
23 slide mechanism
24 slide mechanism rail
25 vertical distance
26,27 ends of the guide of the first guide system
28,29 ends of the guide of the second guide system
30 bar

31 spacer screw
32 interspace
33 frictionally engaged spring
34 slot nut
35 groove
36 countersunk screws
37 connecting piece
38 plug-in connector
39 flattened spot
40 passage openings
41 rivets
42 friction surface
KA tilt axis
KM tilting moment
RM righting moment
l1 length of the third synchronization segment
l2 clear width between the first and second synchronization segments
l3 length of the third support segment
l4 length of the fourth support segment

The invention claimed is:

1. An arrangement for guiding a sliding door or folding-sliding door on a furniture panel, comprising:
a first guide system to be fastened to the furniture panel;
a second guide system to be fastened to the furniture panel at a vertical distance from the first guide system, wherein the first and second guide systems each have at least one guide and a guide body displaceably mounted on the at least one guide; and
a support, to which the sliding door or folding-sliding door is to be fastened and which is connected in a movement-coupled manner to the guide bodies of the first and second guide systems,
wherein the support is composed in the vertical direction of at least two support segments,
wherein the at least two support segments are releasably connectable,
and wherein the releasable connection of the at least two support segments is effected via angled plates.

2. The arrangement according to claim 1, wherein the angled plates are connectable to the support segments via a plug-in and screw connection.

3. The arrangement according to claim 1, wherein the at least two support segments include a first support segment connected to the guide body of the first guide system, a second support segment connected to the guide body of the second guide system, and a third support segment which connects the first and second support segments to each other.

4. The arrangement according to claim 3, wherein the third support segment has a fixed length.

5. The arrangement according to claim 4, wherein the at least three support segments includes a fourth support segment which is adjustable in its length.

6. The arrangement according to claim 1, wherein all pre-installed components of the arrangement have a maximum length of 1200 mm and a maximum width of 800 mm, with the result that they can be arranged on a Euro pallet for shipping purposes, the pre-installed components including the first guide system and one of the at least two support segments connected to the guide body of the first guide system.

7. The arrangement according to claim 1, wherein the support has at least two interfaces for fastening the sliding door or folding-sliding door, and wherein the at least two interfaces are arranged on different support segments of the support.

8. The arrangement according to claim 7, wherein the support has at least three interfaces for fastening the sliding door or folding-sliding door, and wherein the at least three interfaces are arranged on different support segments of the support.

9. The arrangement according to claim 7, wherein at least one interface is adjustable in the vertical direction.

10. The arrangement according to claim 1, wherein the support or the at least two support segments are formed substantially L-shaped in cross section, and/or have at least one recess.

11. A piece of furniture comprising:
at least one furniture panel;
at least one sliding door or folding-sliding door; and
the arrangement according to claim 1, wherein the first and second guide systems are fastened to the at least one furniture panel, and the at least one sliding door or folding-sliding door is secured to the support.

12. The piece of furniture according to claim 11, wherein the piece of furniture has a receiving area for receiving components of a kitchen or a clothes-storage device.

13. A method for installing the arrangement according to claim 1 on a furniture panel, the method comprising:
fastening one of the first and second guide systems to the furniture panel;
fastening the other of the first and second guide systems to the furniture panel at a vertical distance from the one of the first and second guide systems; and
connecting the guide bodies of the first and second guide systems to each other in a movement-coupled manner via the support, wherein the at least two support segments of the support are releasably connected.

14. The method according to claim 13, wherein the arrangement has at least one synchronization device, the method further comprising arranging the at least one synchronization device between the guide bodies of the first and second guide systems, wherein at least two synchronization segments of the synchronization device are releasably connected.

15. The method according to claim 13, further comprising moving the support in the horizontal direction for the installing of the arrangement.

16. The method according to claim 15, wherein the arrangement has at least one synchronization device, the method further comprising moving the at least one synchronization device in the horizontal direction for the installing of the arrangement.

17. The arrangement according to claim 1, wherein all pre-installed components of the arrangement have a maximum length of 1200 mm and a maximum width of 800 mm, with the result that they can be arranged on a Euro pallet for shipping purposes, the pre-installed components including the second guide system and one of the at least two support segments connected to the guide body of the second guide system.

18. The arrangement according to claim 1, wherein all pre-installed components of the arrangement have a maximum length of 1200 mm and a maximum width of 800 mm, with the result that they can be arranged on a Euro pallet for shipping purposes, the pre-installed components including one of the at least two support segments pre-installed with the angled plates via rivets.

19. An arrangement for guiding a sliding door or folding-sliding door on a furniture panel, comprising:
a first guide system to be fastened to the furniture panel;
a second guide system to be fastened to the furniture panel at a vertical distance from the first guide system, wherein the first and second guide systems each have at least one guide and a guide body displaceably mounted on the at least one guide; and a support, to which the sliding door or folding-sliding door is to be fastened and which is connected in a movement-coupled manner to the guide bodies of the first and second guide systems, wherein the support is composed in the vertical direction of at least two support segments, wherein the at least two support segments are releasably connectable, wherein the arrangement has a pull cord device to compensate for a tilting moment of the support or of the sliding door or folding-sliding door arranged thereon about a tilt axis through a righting moment, wherein the pull cord device comprises at least two pull cords separated from each other, wherein a first one of the at least two pull cords is arranged between the guide body of the first guide system and at least one end of the at least one guide of the first guide system and is formed without connection to the second guide system, and wherein a second one of the at least two pull cords is arranged between the guide body of the second guide system and at least one end of the at least one guide of the second guide system and is formed without connection to the first guide system.

20. The arrangement according to claim 19, wherein each of the guide bodies comprises at least one gripping means for at least one pull cord, and the gripping means of the guide bodies are coupled via at least one synchronization device separated from the support.

21. The arrangement according to claim 20, wherein the at least one synchronization device is composed in the vertical direction of at least two synchronization segments, wherein the at least two synchronization segments are releasably connectable.

22. The arrangement according to claim 21, wherein at least one of the synchronization segments is adaptable in its length.

23. The arrangement according to claim 21, wherein the releasable connection of the at least two synchronization segments is effected via sleeves displaceable in the vertical direction.

24. The arrangement according to claim 20, wherein the at least one synchronization device is formed to transmit a torque between the gripping means of the guide bodies.

* * * * *